US007096700B2

(12) United States Patent
Marando

(10) Patent No.: US 7,096,700 B2
(45) Date of Patent: Aug. 29, 2006

(54) METHOD FOR PERFORMING A HYDROFORMING OPERATION

(75) Inventor: Richard A. Marando, Mohrsville, PA (US)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 11/235,671

(22) Filed: Sep. 26, 2005

(65) Prior Publication Data

US 2006/0065031 A1 Mar. 30, 2006

Related U.S. Application Data

(60) Provisional application No. 60/613,819, filed on Sep. 28, 2004.

(51) Int. Cl.
*B21D 26/02* (2006.01)
*B21D 9/15* (2006.01)

(52) U.S. Cl. ..... 72/58; 72/57; 72/61

(58) Field of Classification Search ..... 72/58, 72/60, 61, 62; 29/421.1
See application file for complete search history.

(56) References Cited

U.S. PATENT DOCUMENTS 4,829,803 A 5/1989 Cudini
5,070,717 A 12/1991 Boyd et al.
RE33,990 E 7/1992 Cudini
5,333,775 A 8/1994 Bruggemann et al.
5,630,334 A * 5/1997 Ash ..... 72/61
5,644,829 A 7/1997 Mason et al.
6,006,567 A * 12/1999 Brown et al. ..... 72/58
6,257,035 B1 * 7/2001 Marks et al. ..... 72/57
6,415,638 B1 * 7/2002 Sakurai et al. ..... 72/57
6,739,166 B1 * 5/2004 Shah ..... 72/57

* cited by examiner

*Primary Examiner*—David Jones
(74) *Attorney, Agent, or Firm*—MacMillan, Sobanski & Todd, LLC

(57) ABSTRACT

A method for performing a hydroforming operation on a hollow workpiece includes the initial step of filling the interior of the workpiece with a hydroforming fluid. The pressure exerted by the hydroforming fluid against the interior of the workpiece is below the yield strength of the workpiece so as to not change the shape of the workpiece. Then, first and second die sections of the hydroforming apparatus are closed about the workpiece. The movement of the two die sections causes some mechanical deformation of the workpiece, but the presence of the hydroforming fluid within the workpiece prevents the amount of this mechanical deformation of the hollow workpiece from being undesirably large. Thereafter, the pressure exerted by the hydroforming fluid against the interior of the workpiece is increased to above the yield strength of the workpiece. As a result, the workpiece is deformed into engagement with the first and second die sections of the hydroforming die.

4 Claims, 8 Drawing Sheets

METHOD FOR PERFORMING A HYDROFORMING OPERATION

CROSS-REFERENCE TO RELATED APPLICATIONS

This application claims the benefit of U.S. Provisional Application No. 60/613,819, filed Sep. 28, 2004, the disclosure of which is incorporated herein by reference.

BACKGROUND OF THE INVENTION

This invention relates in general to methods for hydroforming hollow or closed channel workpieces to achieve desired shapes. In particular, this invention relates to an improved method for performing a hydroforming operation that resists the tendency of the workpiece to be deformed inwardly upon itself when the closed channel workpiece is initially being enclosed by a pair of opposed hydroforming dies of a hydroforming apparatus.

Hydroforming is a well known metal working operation that uses pressurized fluid to deform a closed channel workpiece, such as a tubular member, outwardly into conformance with a die cavity having a desired shape. A typical hydroforming apparatus includes a frame having two or more hydroforming die sections that are supported thereon for relative movement between opened and closed positions. The die sections have cooperating recesses formed therein that together define a die cavity having a shape that corresponds to a desired final shape for the workpiece. When moved to the opened position, the die sections are spaced apart from one another to allow a workpiece to be inserted within or removed from the die cavity. When moved to the closed position, the die sections are disposed adjacent to one another so as to enclose the workpiece within the die cavity. Thereafter, the workpiece is filled with a fluid, typically a relatively incompressible liquid, such as water. The pressure of the fluid within the workpiece is increased to such a magnitude that the workpiece is expanded outwardly into conformance with the die cavity. As a result, the workpiece is deformed or expanded into the desired final shape.

Although the die cavity is usually somewhat larger than the workpiece to be hydroformed, the movement of the two die sections from the opened position to the closed position may, in some instances, cause some mechanical deformation of the hollow workpiece. A relatively small amount of this mechanical deformation is usually acceptable. However, in some instances, the amount of this mechanical deformation of the hollow workpiece is relatively large. Such relatively large deformation of the hollow workpiece can be undesirable because it may result in undesirable work hardening of the workpiece and inhibit the free flow of the material of the workpiece during the subsequent performance of the hydroforming operation. Thus, it would be desirable to provide an improved method for performing a hydroforming operation that resists the tendency of the workpiece to be deformed inwardly upon itself when the closed channel workpiece is initially being enclosed by a pair of opposed hydroforming dies of a hydroforming apparatus.

SUMMARY OF THE INVENTION

This invention relates to an improved method for performing a hydroforming operation that resists the tendency of the workpiece to be deformed inwardly upon itself when the closed channel workpiece is initially being enclosed by a pair of opposed hydroforming dies of a hydroforming apparatus. Initially, the interior of the workpiece is completely or substantially completely filled with a hydroforming fluid. The pressure exerted by the hydroforming fluid against the interior of the workpiece is relatively small, preferably well below the yield strength of the workpiece so as to not change the shape of the workpiece. Then, first and second die sections of the hydroforming apparatus are closed about the workpiece. The movement of the two die sections causes some mechanical deformation of the workpiece, but the presence of the hydroforming fluid within the workpiece prevents the amount of this mechanical deformation of the hollow workpiece from being undesirably large. Thereafter, the pressure exerted by the hydroforming fluid against the interior of the workpiece is increased to above the yield strength of the workpiece. As a result, the workpiece is deformed into engagement with the first and second die sections of the hydroforming die.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
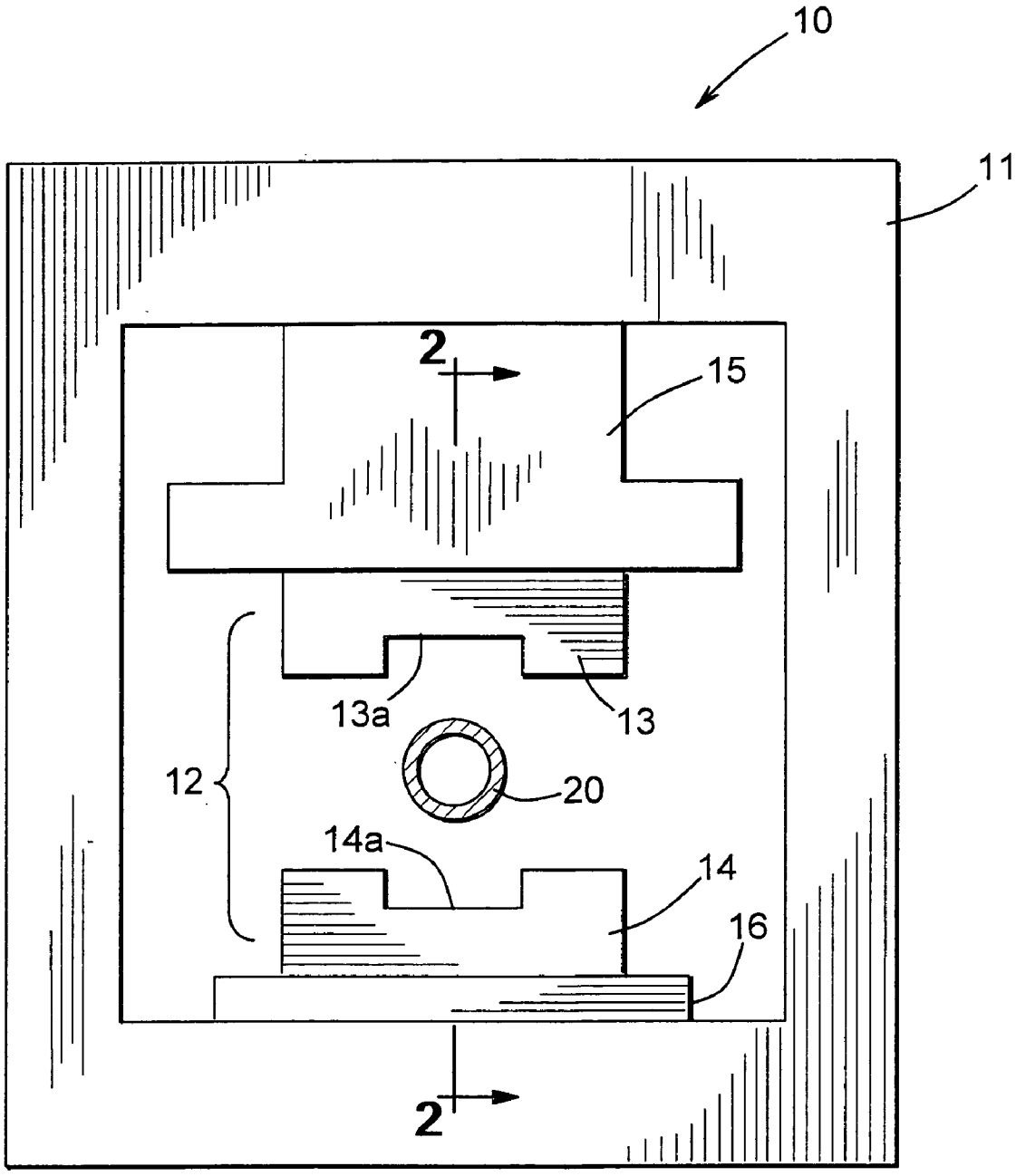
FIG. 1 is a side elevational view of a hydroforming apparatus including a pair of hydroforming die sections that are shown in an open position prior to the commencement of a hydroforming operation in accordance with the method of this invention.
Figure 2:
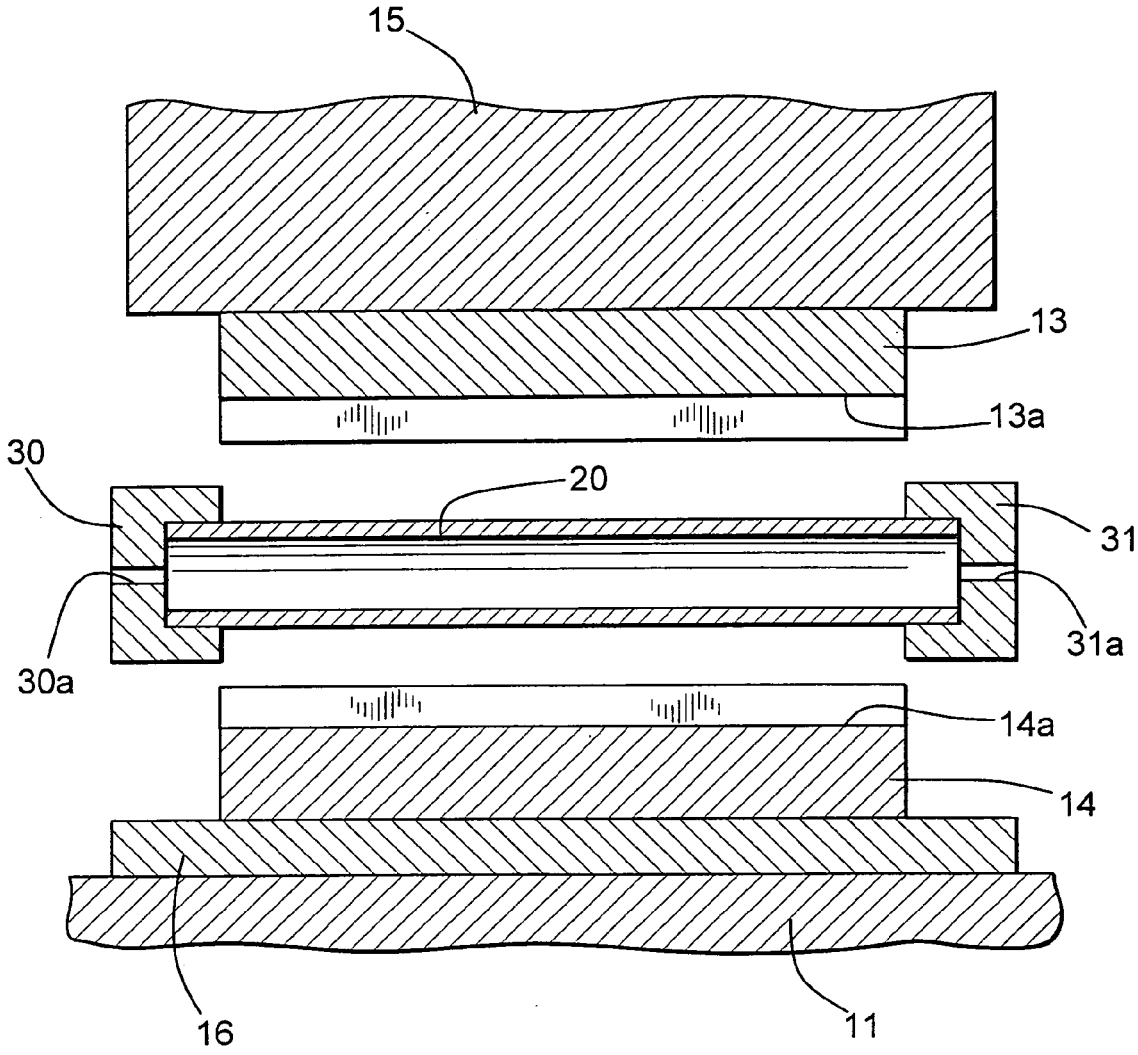
FIG. 2 is a sectional elevational view of the hydroforming apparatus taken along line 2—2 of FIG. 1.

Referring now to the drawings, there is illustrated in FIGS. 1 and 2 an apparatus, indicated generally at 10, for performing a hydroforming operation in accordance with the method of this invention. The illustrated hydroforming apparatus 10, which is intended to be representative of any structure that is capable of performing the hydroforming operation described below, includes a frame 11 that is sized to support a hydroforming die 12 in a generally vertically oriented relationship. Although this invention will be described and illustrated in the context of a single, vertically oriented hydroforming die 12, it will be appreciated that this invention can be practiced with a greater number of such hydroforming dies if desired. Furthermore, the hydroforming die 12 can be oriented within the hydroforming apparatus 10 in any desired direction other than the illustrated vertical direction, such as in the horizontal direction for example.

The hydroforming die 12 includes a pair of cooperating die sections 13 and 14 that have respective recesses 13*a* and 14*a* formed therein. The first die section 13 of the hydroforming die 12 is preferably mounted on or otherwise connected to a first portion of the hydroforming apparatus 10, such as a ram 15, for movement therewith. The second die section 14 of the hydroforming die 12 is preferably connected to or formed integrally with a second portion of the hydroforming apparatus 10, such as a stationary bed 16. Prior to the commencement of an operational cycle of the hydroforming apparatus 10, the various components thereof are oriented in an opened position illustrated in FIGS. 1 and 2. In this opened position, the ram 15 is located upwardly relative to the bed 16 so as to position the first die section 13 of the hydroforming die 12 in an uppermost spaced apart position relative to the second die section 14. As will be explained in detail below, the various components of the hydroforming apparatus 10 can be moved to a closed position, wherein the ram 15 is located downwardly relative to the bed 16 so as to position the first die section 13 of the hydroforming die 12 in abutment with the second die section 14. When the two die sections 13 and 14 are moved together in the closed position, the recesses 13*a* and 14*a* formed therein cooperate to define a die cavity 17 (see FIG. 5).

Prior to the commencement of the hydroforming operation, a hollow or closed channel workpiece 20 is inserted between the spaced apart die sections 13 and 14 of the hydroforming die 12. The illustrated workpiece 20 is generally tubular in shape, being substantially linear and having a substantially circular in cross-sectional shape. However, it should be understood that the invention is not limited to any specific shape of the workpiece 20, and that the invention can be practiced using a workpiece having any desired shape that can be disposed between the cooperating die sections 13 and 14 of the hydroforming die 12, as shown in FIGS. 1 and 2. If desired, the workpiece 20 may be mechanically or otherwise pre-bent on a conventional tube bending apparatus (not shown) before being disposed between the cooperating die sections 13 and 14 of the hydroforming die 12. Such pre-bending of the workpiece 20 is often desirable to facilitate the proper orientation of the workpiece 20 relative to the cooperating die sections 13 and 14 of the hydroforming die 12 in anticipation of the performance of the subsequent hydroforming operation. The workpiece 20 can be formed from any desired material or group of materials and can be manufactured using any desired process or processes.

After the workpiece 20 has been inserted between the spaced apart die sections 13 and 14 of the hydroforming die 12, a pair of end feed cylinders 30 and 31 are moved laterally into engagement with the ends thereof, as shown in FIG. 2. The end feed cylinders 30 and 31 are conventional in the art and have respective passageways 30*a* and 31*a* formed therethrough to facilitate the filling and emptying of the workpiece 20 with a hydroforming fluid. Either or both of the passageways 30*a* and 31*a* may be connected to a source of pressurized fluid (not shown). The hydroforming fluid is typically embodied as a relatively incompressible liquid, such as water. The illustrated end feed cylinders 30 and 31 are intended to be representative of any mechanism or mechanisms for sealing the ends of the workpiece 20, for supplying pressurized hydroforming fluid into the interior of the workpiece 20 to initiate the hydroforming process, and for emptying hydroforming fluid from the interior of the workpiece 20 at the conclusion of the hydroforming operation. As is known in the art, the end feed cylinders 30 and 31 can also be used to exert inwardly directed forces against the lateral ends of the workpiece 20 during the hydroforming operation, as will be explained further below.

Figure 3:
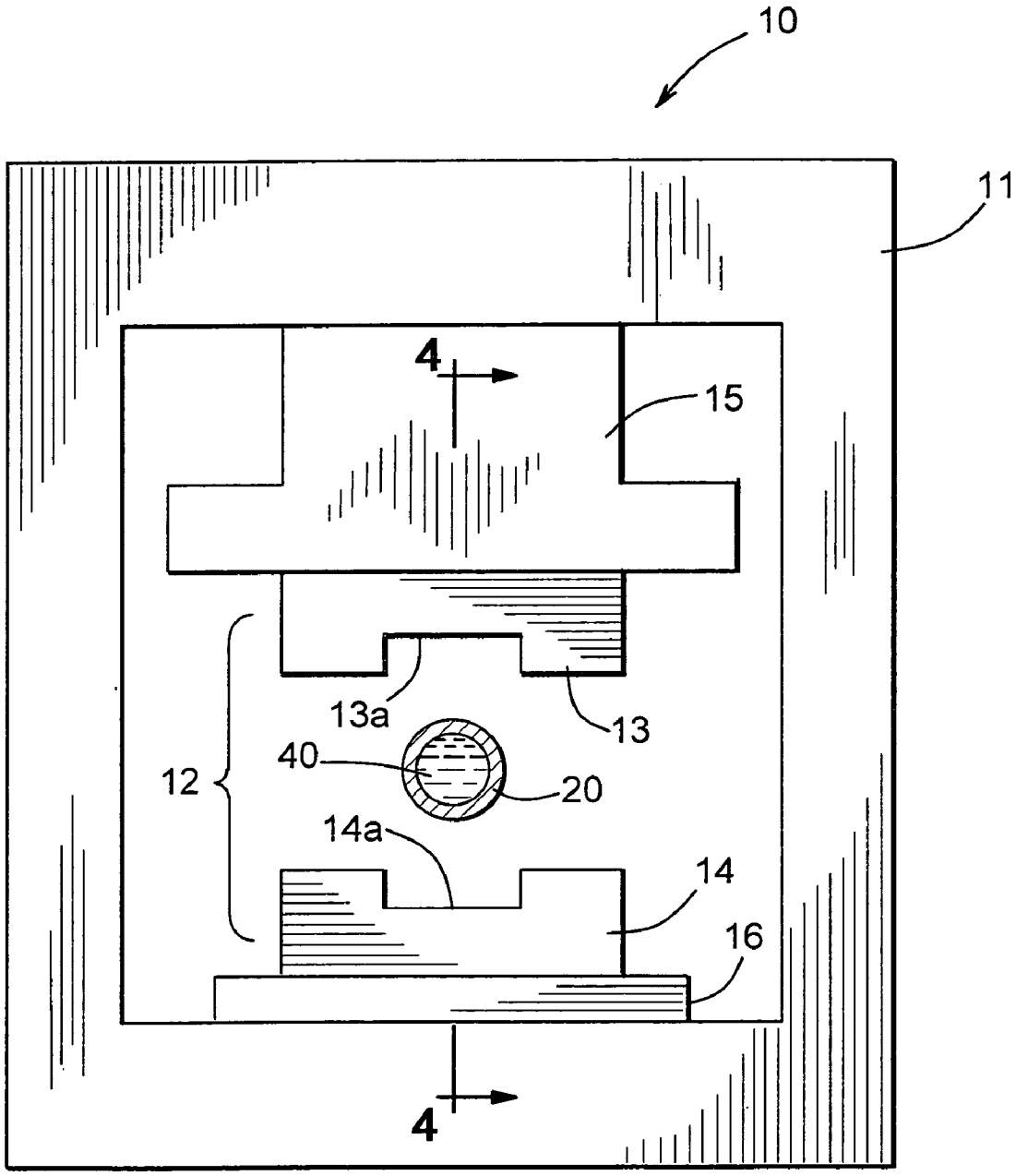
FIG. 3 is a side elevational view of the hydroforming apparatus illustrated in FIG. 1 showing a first step in the method of this invention.
Figure 4:
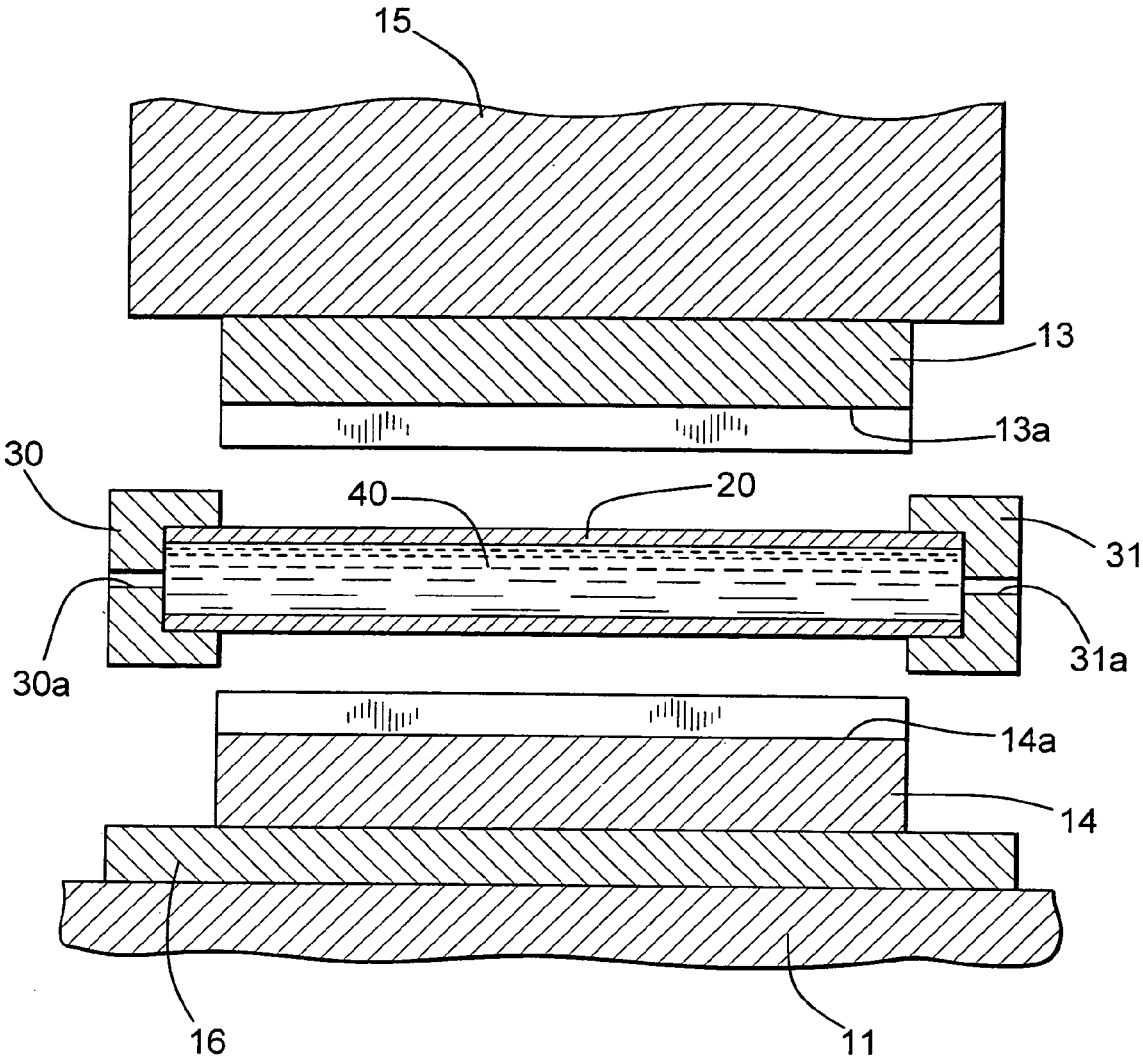
FIG. 4 is a sectional elevational view of the hydroforming apparatus taken along line 4—4 of FIG. 3.

A first step in the method of this invention is illustrated in FIGS. 3 and 4, wherein the hydroforming apparatus 10 is shown after a quantity of hydroforming fluid 40 has been supplied through the passageways 30*a* and 31*a* formed through the end feed cylinders 30 and 31 into the interior of the workpiece 20. The interior of the workpiece 20 is preferably completely or substantially completely filled with the hydroforming fluid 40. However, the pressure exerted by the hydroforming fluid 40 against the interior of the workpiece 20 is relatively small, preferably well below the yield strength of the workpiece 20. Thus, in this first step in the method of this invention, the shape of the workpiece 20 is preferably not changed by the hydroforming fluid 40 contained therein. If desired, the workpiece 20 can be pre-filled with the hydroforming fluid 40 before being inserted between the spaced apart die sections 13 and 14 of the hydroforming die 12. To accomplish this, the lateral ends of the workpiece 20 can be closed by respective seals (not shown) to facilitate the insertion of the filled workpiece 20 between the spaced apart die sections 13 and 14 of the hydroforming die 12.

Figure 5:
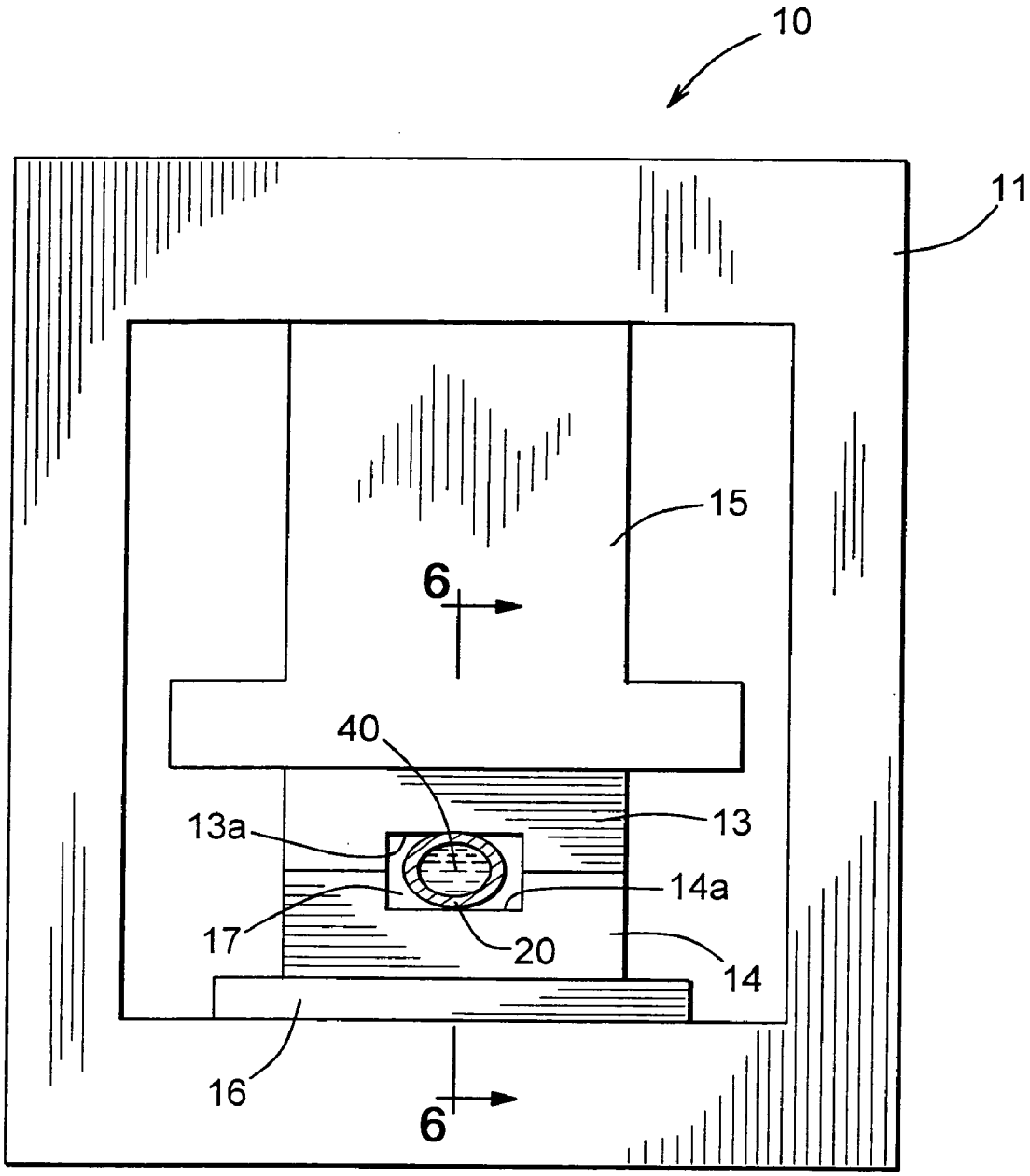
FIG. 5 is a side elevational view of the hydroforming apparatus illustrated in FIG. 3 showing a second step in the method of this invention.
Figure 6:
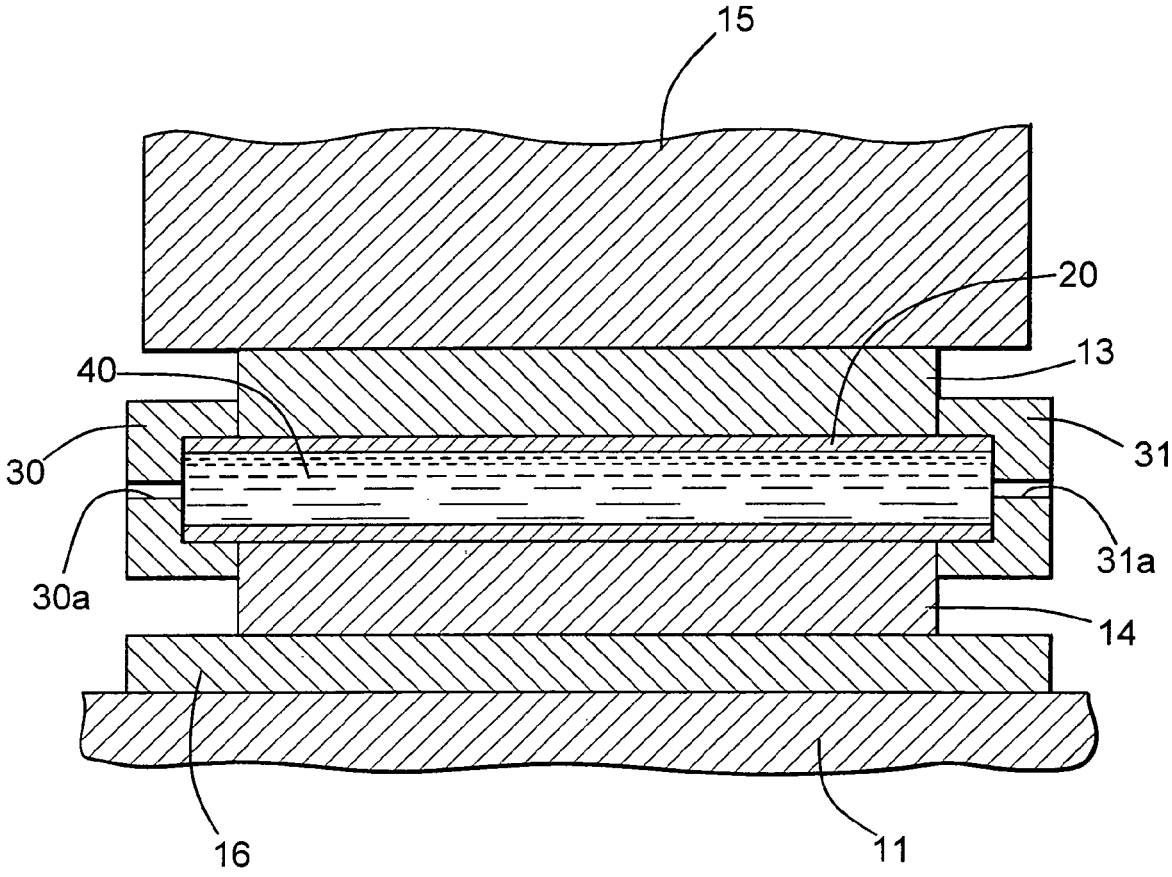
FIG. 6 is a sectional elevational view of the hydroforming apparatus taken along line 6—6 of FIG. 5.

A second step in the method of this invention is illustrated in FIGS. 5 and 6, wherein the hydroforming apparatus 10 is shown after the die sections 13 and 14 of the hydroforming die 12 have been moved from the opened position to the closed position. To accomplish this, the ram 15 of the hydroforming apparatus 10 (and the first section 13 secured thereto) can be actuated to move downwardly toward the bed 16 (and the second die section 14 secured thereto). As mentioned above, when the two die sections 13 and 14 are moved together in the closed position, the recesses 13*a* and 14*a* formed therein cooperate to define the die cavity 17. Although the die cavity 17 is usually somewhat larger than the workpiece 20 to be hydroformed, the movement of the two die sections 13 and 14 from the opened position to the closed position may, in some instances, cause some mechanical deformation of the hollow workpiece 20, such as best shown in FIG. 5. A relatively small amount of this mechanical deformation is usually acceptable. However, the presence of the hydroforming fluid 40 within the workpiece 20 prevents the amount of this mechanical deformation of the hollow workpiece 20 from being relatively large. Such relatively large deformation of the hollow workpiece 20 can be undesirable because it may result in undesirable work hardening of the workpiece 20 and inhibit the free flow of the material of the workpiece 20 during the subsequent performance of the hydroforming operation described below.

Figure 7:
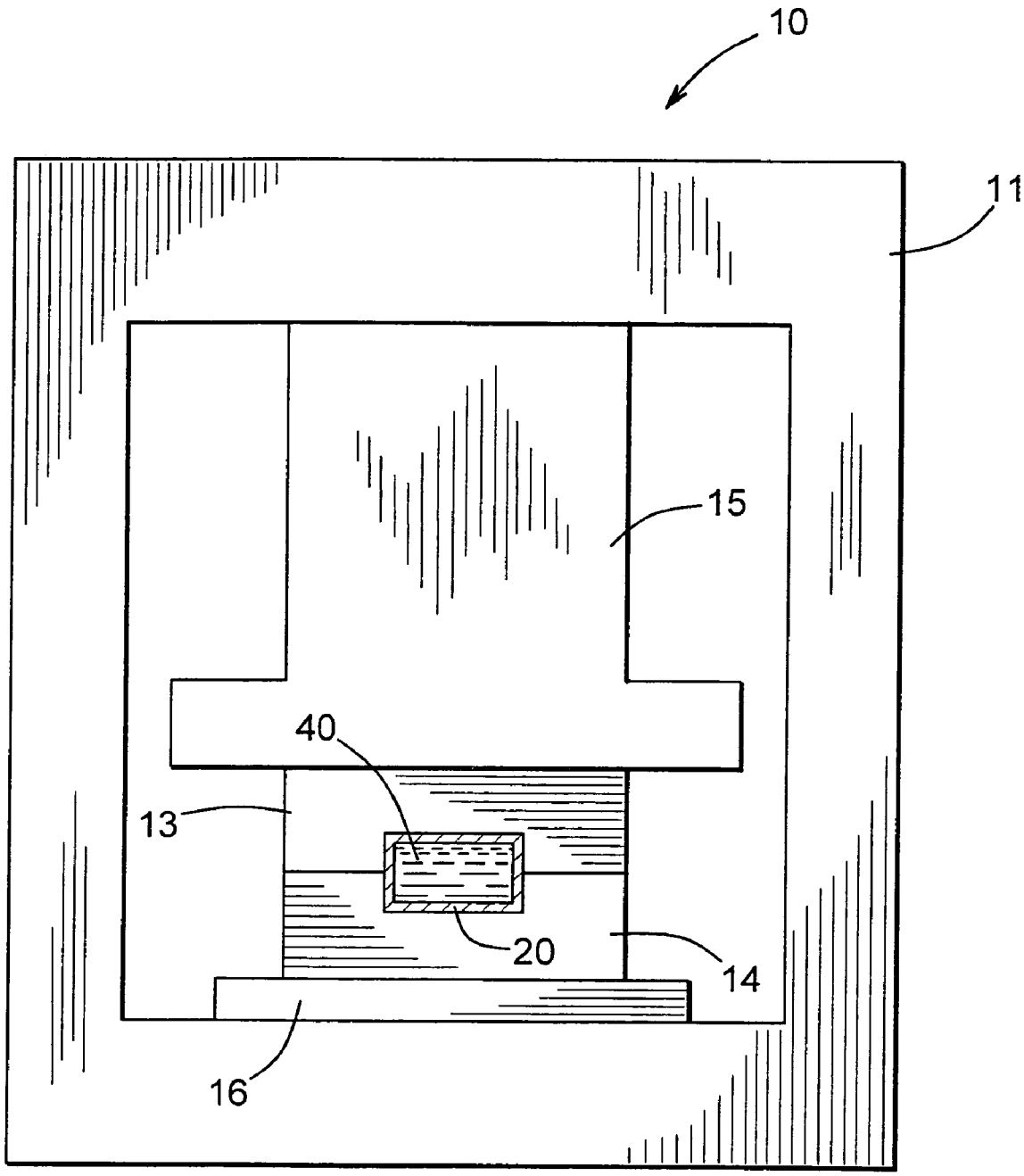
FIG. 7 is a side elevational view of the hydroforming apparatus illustrated in FIG. 6 showing a third step in the method of this invention.

A third step in the method of this invention is illustrated in FIG. 7, wherein the hydroforming apparatus 10 is shown after the pressure exerted by the hydroforming fluid 40 against the interior of the workpiece 20 has been increased to above the yield strength of the workpiece 20. As a result, the workpiece 20 is expanded outwardly into engagement with the recesses 13*a* and 14*a* formed in the first and second die sections 13 and 14 of the hydroforming die 12. Such expansion causes the workpiece 20 to conform with the shape of the die cavity 17, as shown in FIG. 7. Thereafter, the hydroforming fluid 40 is removed from the workpiece 20, the die sections 13 and 14 are returned to the opened positions, and the deformed workpiece 20 is removed from the hydroforming apparatus 10.

Figure 8:
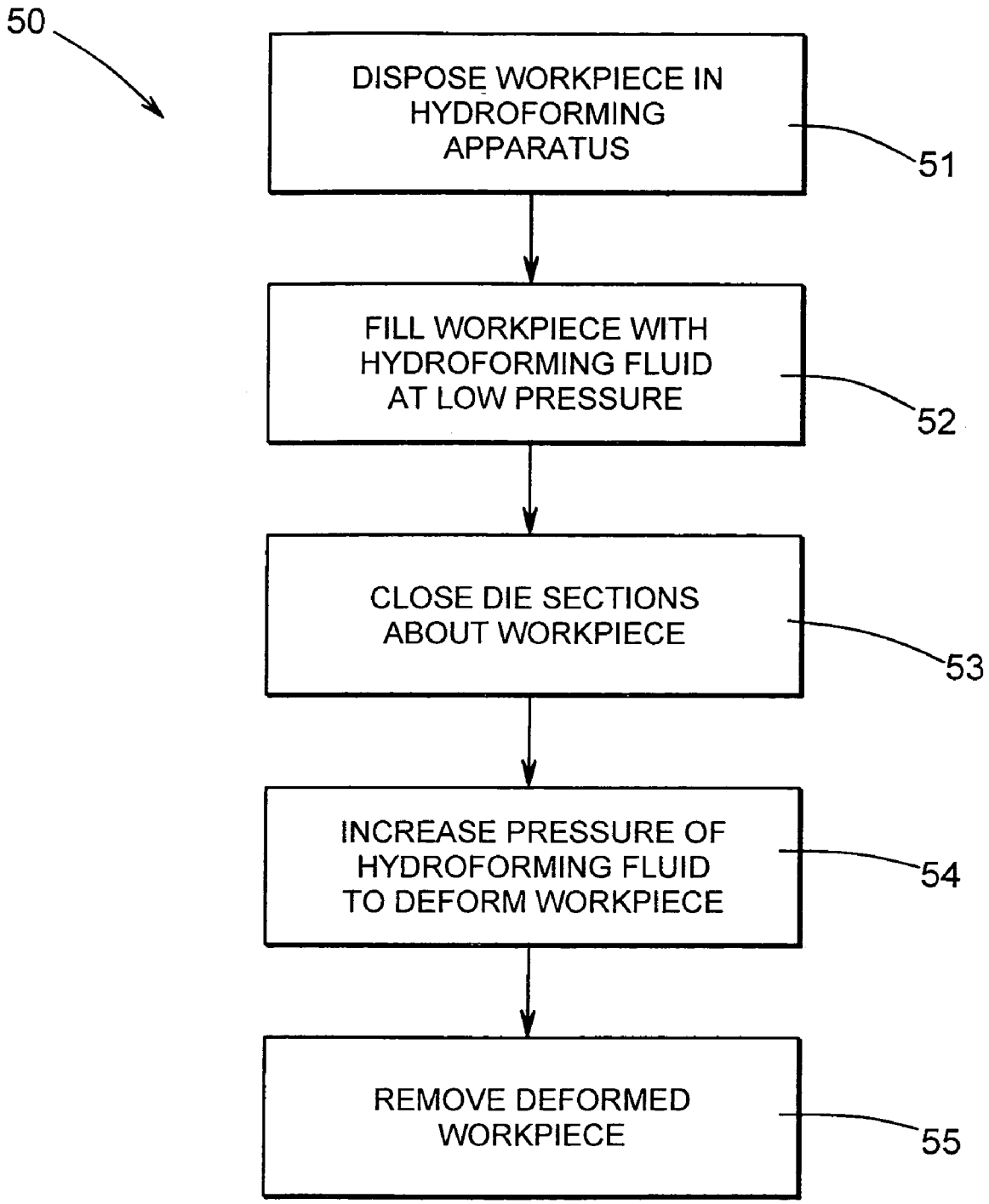
FIG. 8 is a flowchart of the method for performing a hydroforming operation in accordance with this invention.

FIG. 8 is a flowchart of the method, indicated generally at 50, for performing the above-described hydroforming operation in accordance with this invention. In a first step 51 of the method 50, the workpiece 20 is disposed within the hydroforming apparatus 10. Then, in a second step 52 of the method 50, the workpiece 20 is filled with the hydroforming fluid 40. These first two steps 51 and 52 of the method 50 can, as mentioned above, be performed in any desired order. Thus, as shown in FIGS. 1 through 4, the workpiece 20 can be initially disposed within the hydroforming apparatus 10, then filled with the hydroforming fluid 40. Alternatively, the workpiece 20 can be initially filled with the hydroforming fluid 40, then disposed within the hydroforming apparatus 10. In either event, the pressure exerted by the hydroforming fluid 40 against the interior of the hollow workpiece 20 is relatively small, less than the yield strength of the workpiece 20.

Next, in a third step 53 in the method 50 of this invention, the die sections 13 and 14 of the hydroforming die 12 are closed about the workpiece 20. As mentioned above, the presence of the hydroforming fluid 40 within the workpiece 20 prevents the amount of this mechanical deformation of the hollow workpiece 20 from being relatively large. Such relatively large deformation of the hollow workpiece 20 can be undesirable because it may result in undesirable work hardening of the workpiece 20 and inhibit the free flow of the material of the workpiece 20 during the subsequent performance of the hydroforming operation described below.

In a fourth step 54 of the method 50 of this invention, the pressure exerted by the hydroforming fluid 40 against the interior of the workpiece 20 is increased to above the yield strength of the workpiece 20. As a result, the workpiece 20 is expanded outwardly into engagement with the recesses 13*a* and 14*a* formed in the first and second die sections 13 and 14 of the hydroforming die 12. Such expansion causes the workpiece 20 to conform with the shape of the die cavity 17, as shown in FIG. 7. Thereafter, in a fifth step 55 in the method 50 of this invention, the hydroforming fluid 40 is removed from the workpiece 20, the die sections 13 and 14 are returned to the opened positions, and the deformed workpiece 20 is removed from the hydroforming apparatus 10.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A method of performing a hydroforming operation on a hollow workpiece comprising the steps of:

(a) filling an interior of a hollow workpiece with a hydroforming fluid at a relatively low pressure, then disposing the filled workpiece within a hydroforming apparatus having first and second die sections;

(b) closing the first and second die sections about the workpiece to define a die cavity and to initially deform the workpiece; and (c) increasing the pressure of the hydroforming fluid within the workpiece to a relatively high pressure so as to deform the workpiece into conformance with the die cavity.

2. The method defined in claim 1 wherein said step (a) is performed by filling the interior of a hollow workpiece with a hydroforming fluid that exerts a pressure that is less than a yield strength of the workpiece.

3. The method defined in claim 1 wherein said step (b) is performed by providing the hydroforming apparatus with a ram that supports the first die section and a base that supports the second die section and causing the ram of the hydroforming apparatus to move toward the base.

4. The method defined in claim 1 wherein said step (c) is performed by increasing the pressure of the hydroforming fluid within the workpiece to a pressure that is greater than a yield strength of the workpiece.

* * * * *